US005932067A

United States Patent [19]

Groudinine

[11] Patent Number: 5,932,067

[45] Date of Patent: Aug. 3, 1999

[54] METHOD AND APPARATUS FOR PROCESSING A FIBROUS MASS IN A SPIRAL SHAPED FLOW-TYPED TUBE CELL

[75] Inventor: Vladimir Pavlovich Groudinine, Arkhangelsk, Russian Federation

[73] Assignee: Vitaly Valerievich Pukanov, Arkhangelsk, Russian Federation; a part interest

[21] Appl. No.: 08/875,067

[22] PCT Filed: Jan. 4, 1996

[86] PCT No.: PCT/RU96/00004

§ 371 Date: Jul. 16, 1997

§ 102(e) Date: Jul. 16, 1997

[87] PCT Pub. No.: WO96/22418

PCT Pub. Date: Jul. 25, 1996

[30] Foreign Application Priority Data

Jan. 16, 1995 [RU] Russian Federation ..... 95100584

[51] Int. Cl.[6] ..... D21C 7/06

[52] U.S. Cl. ..... 162/59; 162/58; 162/52; 422/185; 422/232

[58] Field of Search ..... 162/63, 59, 65, 162/66, 67, 78, 243, 52, 87; 261/79.2; 266/172; 422/185, 234, 292, 232; 366/102, 169.2

[56] References Cited

U.S. PATENT DOCUMENTS 5,160,581 11/1992 Titmas ..... 162/61

FOREIGN PATENT DOCUMENTS

| | | |
|---|---|---|
| 0 226 495 | 6/1987 | European Pat. Off. . |
| 0 475 930 | 3/1992 | European Pat. Off. . |
| 2227388 | 11/1974 | France . |
| 209964 | 4/1968 | Russian Federation . |
| 1139782 | 2/1985 | Russian Federation . |
| 1836518 | 8/1993 | Russian Federation . |
| 736491 | 9/1955 | United Kingdom . |
| WO90/06395 | 6/1990 | WIPO . |

*Primary Examiner*—Stanley S. Silverman
*Assistant Examiner*—Dean T. Nguyen
*Attorney, Agent, or Firm*—Jacobson, Price, Holman & Stern, PLLC

[57] ABSTRACT

The invention is directed towards the method of processing of fibrous mass by a chemical agent and the set up needed for the conducting of the process. Fibrous mass is mixed with a gas transfer agent in the mixing cell and goes to the flow-type tube cell which is shaped like a spiral with the 1:18–1:60 ratio between tube and loop diameters. The chemical agent is transferred immediately to the reactor throughout the jets attached to the reactor lengthwise. The process is carried out in a turbulent regime of motion of the reaction mixture with the velocity of 1–50 m/s. The current invention allows to reach the higher effective processing of fibrous mass, to reduce the consumption of the chemical agent and to increase the quality of the processed material. It can be utilized in paper and pulp industry for the processing of cellulose using a bleaching agent.

6 Claims, 1 Drawing Sheet

METHOD AND APPARATUS FOR PROCESSING A FIBROUS MASS IN A SPIRAL SHAPED FLOW-TYPED TUBE CELL

TECHNICAL SECTION

The current invention is concerned with the processing of fibrous substance by the use of a chemical agent and set up required which can be engaged in paper and pulp industry as well as bleach use.

PRELIMINARY LEVEL OF TECHNOLOGY

Presently, processing of fiber, as well as paper and pulp fiber, is fulfilled by the use of chemical agents with variety of methods. Some processes, like chlorine bleaching in the presence of suspended substrate (USSR Patent No 282053, 1970), chlorinating of paper and pulp fiber in the adsorption column (USSR Patent No 209964, 1968) or some methods of fiber bleaching, carried out with such gaseous agents as ozone, oxygen and chlorine in the column reactor (USSR Patent, No 365411, 1973), are well known. Some methods of fiber treating with gaseous agents with the use of certain devices, provided with a cycling transfer tape for maintenance of a proper mass stratum (USSR Patent No 544724, 1977), are also known.

Nonetheless, all the methods reviewed are characterized by insufficient mass transfer in the reaction zone, furthermore, agent utilization constant and quality of the product are considered to be low. Chemical agents, engaged in these processes, do not allow to conduct the processing of highly concentrated fibrous mass and require a large amount of metal for equipment and complexity of service in use.

The closest method to the needed one is a method of fiber processing through the agency of treating with a gaseous agent in the flow reactor, which beats all the faults revised above (Russian Federation Patent No 903419, 993). This one can be used in the process of pulp and paper bleaching by a gaseous agent. Thus, fiber concentration over 15 percent, calculated from the dry substrate, can be achieved in the portions, transferred throughout the load cell to the mixing cell with the gaseous agent, followed by transfer of the reaction mixture to the stream cell, connected to the cell for accumulation of processed fiber. The main fault of the current method is that the mass transfer in the reaction zone is insufficient and there is no uniform distribution of the reagent mass in the volume. Therefore, low agent utilization constant occurs, and no proper quality of processed fiber can be attained (the estimated level of bleaching is no more than 55 percent).

This invention is directed towards the high quality methods of fiber processing with a chemical agent which contributes uniform processing of material in the whole volume of the reaction mass, decreasing of agent consumption, high quality of processed fiber (in particular, increasing of bleaching level of the pulp mass), opportunity to process the fiber of high concentrations using the large number of various chemical agents, in gas or liquid conditions as well.

DESCRIPTION OF THE INVENTION

The task set is solved by the way of preliminary mixing of fiber with a gas transfer agent in the mixing cell, followed by the transfer of formed mix into the tube cell, which is spiral shaped and looped round the accumulation cell for processed fibrous mass with the 1:18–1:60 ratio between tube and loop diameters. Following this scheme, chemical agent is transferred throughout the jets, which are stretched lengthwise, and the process is conducted in a turbulent regime of the mass flow with the velocity 1–50 m/s.

The difference between this method and the known one is that the chemical agent is transferred directly to the reactor from the jets attached to its sides lengthwise and the process is conducted in a turbulent regime of flow with the velocity 1–50 m/s. The reactor, so far, is spiral shaped and looped round the cell for accumulation of processed fiber, with the 1:18–1:60 ratio between tube and loop diameters.

Conducting of fiber processing in a turbulent flow of the reaction mixture, moving throughout the cell with the velocity 1–50 m/s, promotes the appreciable intensification of mass transfer processes in the reaction zone. The turbulent regime of flow of the reaction mixture is promoted in a certain interval of the velocities of motion and in the certain ratio between tube and loop diameters. Feed of a chemical reagent directly to the cell from the jets, attached to the sides of the cell, promotes the uniform processing of fiber in a whole volume of the reaction mass and allows to attain the additional mixing of the reaction mass. Fibrous mass, particularly dispersed by flow of the transfer agent in the mixing cell, is treated with the further dispersion, forced by restraints from the sides of the cell, moving with the velocity 1–50 m/s through the cell which is spiral shaped according to the 1:18–1:60 ratio between tube and loop diameters. This additional layer formation of fiber structure promotes the increasing of the reaction surface what induces up almost 100 percent utilization of the chemical agent. Reaction mass analysis on the outlet from the reactor indicates that the chemical agent does not exist there any more. Specific spiral shape of the reactor, looped round the accumulation cell, provides the mobility of the device and reduction of the surface engaged.

Required levels of mixing and dispersion of the fibrous mass and corresponding high efficiency of the process of treating with a chemical agent are reached in the certain intervals of velocity values of the reaction mass in the cell (1–50 m/s) and ratio between tube and loop diameters (1:18–60). As the reaction mass moves with the velocity less than 1 m/s, it causes some unstable conditions of processing for the motion of the reaction mass occurs in a pulsation mode, therefore all the dominant properties like whiteness, utilization constant, etc. are failed. As the velocity reaches over 50 m/s the process is characterized by abundant power utilization. Decreasing the current ratio between tube and loop diameters must induce unstable work of the reactor as well as in case of increasing of this ratio the quality of product becomes low.

Following the current method, the fibrous mass is preliminary mixed with the transfer agent. This allows to conduct mixing with the 10–60:1 ratio between the masses of fiber and transfer agent. Increasing this ratio higher than 60:1 may result an accidental situation, caused by clogging the reactor, whereas the decreasing of the ratio lower than 10:1 is economically unreasonable. The chemical agent used in the process can be a gas like oxygen, ozone or chlorine or a liquid system like aqueous solution of chlorine dioxide or hydrogen peroxide.

Since the chemical reagent is a gas there is no use of it as a transfer agent. In this case a part of the gaseous chemical agent enters in the mixing cell as a transfer agent and obtained mixture follows to the reactor. Residual part of the gaseous agent enters the reactor immediately from the jets, attached lengthwise.

It is also possible to use air or distilled vapor as a transfer agent. As is often used as a transfer agent in case of processing the fibrous mass by the aqueous solutions of oxidant.

The current method allows to process the highly concentrated fibrous mass with a concentration interval of the dry substance of 35–90 per cent by weight.

BRIEF DESCRIPTION OF THE FIGURES

The essence of the invention is elucidated by the following figures.

THE PREFERRED EMBODIMENT OF THE METHOD

Figure 1:
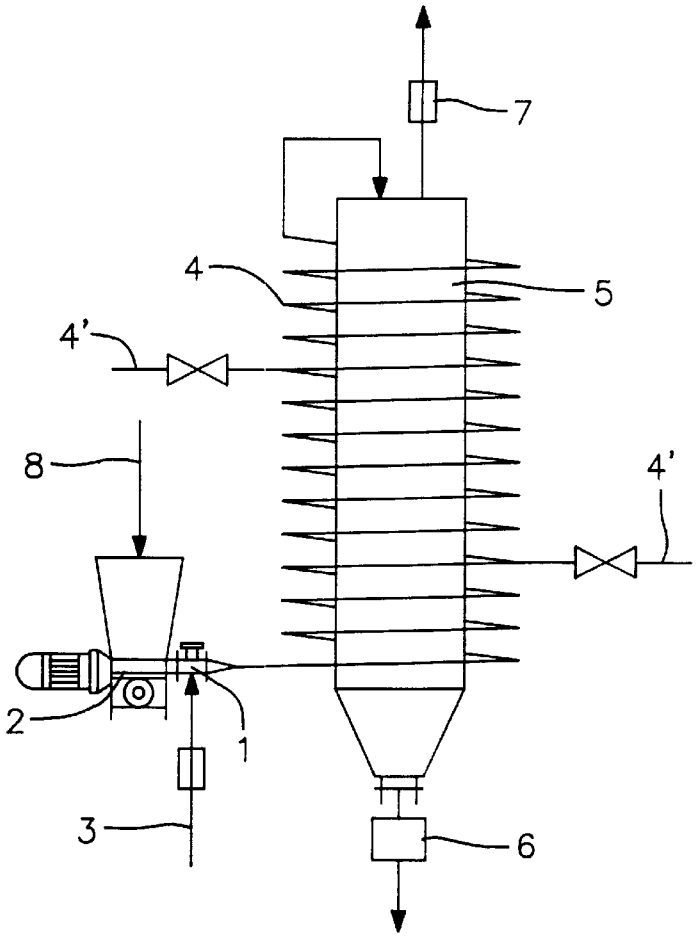
FIG. 1: Set up scheme for fiber processing.
Figure 2:
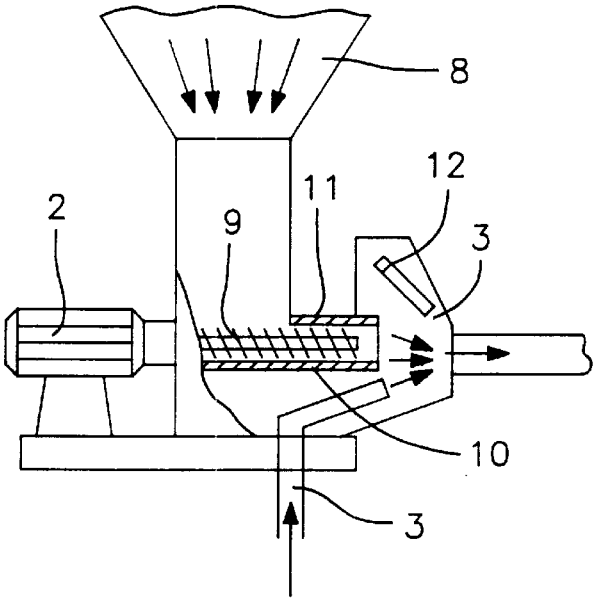
FIG. 2: The device for feed of the fibrous mass, the mixing cell and the accommodation for the gas agent inlet.

The device consists of the cell for mixing of the fibrous mass and the gas agent (1), provided with a device for loading the fibrous mass (2) and accommodation for the gas agent entry (3), which can be made like a tube feeding system, and the flow-type tube reactor contacted to the mixing cell, shaped like a spiral, looped round the cell for accumulation of the processed fibrous mass (5) with the 1:18–1:60 ratio between tube and loop diameters.

Reactor is provided with the jets for chemical agent feeding system attached asides (4). The accumulation cell (5) attached to the reactor outlet is provided with a device for pumping of the processed mass (6) and provided with the accommodation for outlet of the utilized gas (7).

The device (Russian Federation Patent No 903419 1993), known before and used for loading of the fibrous mass, consists of the bunker (8), feeder (9), enclosed in the shell (10), which provided with a perforation system (11) for gas ejection from the mass and the back valve (12).

Extents and materials needed for distinct parts of the device depend on a type of the fibrous mass, chemical reagent, conditions of the process and reaction velocity.

The method is conducted by the following way.

Fibrous mass, impregnated with a reaction liquid (water base solution, for instance), is transferred to the bunker (8) of the feeding device (2) where, then, it is taken to the outlet by the feeder (9) where it is formed by pressure into the "mass stopper". During its formation the "mass stopper" loses the air which goes through the perforation holes and finally is taken off the loading device. Formation of the "mass stopper" is followed by increasing of pressure at the back valve (12). As soon as the pressure becomes higher than in the mixing cell the (1) back valve is opened and the portions of the fibrous mass go to the mixing cell (1). The gas transfer agent, transferred to the mixing cell (1) through the accommodation for its inlet (3), takes the mass apart to the fibers. Preferably, the gas agent is consumed in the 10–60:1 ratio between the masses of fiber and transfer agent. The fibrous mass emitted from the mixing cell and grinded to fibers is taken by the transfer agent to the flow-type tube reactor (4) which is formed like a spiral looped round the accumulation cell (5) with the 1:18–1:60 ratio between tube and loop diameters. The chemical reagent goes throughout the jets, attached lengthwise to the reactor, immediately. The velocity of the transferring mixture of fibrous mass with the transfer agent and the velocity of chemical agent feeding are varied in order to reach the reaction mass flow velocity of 1–50 m/s. The processed reaction mass is taken to the accumulation cell (5). In case of conducting the bleaching process of cellulose, the accumulation cell is a column of high concentration, where the utilized mass is accumulated and pumped through the agency of a specific device (6) to the further processing, according to the current regulation manual, and utilized gas is whether taken off through the output unit (7), recycled for secondary use or dumped into the atmosphere.

The invention is illustrated by the following examples.

EXAMPLE 1

Paper and pulp mass pressed to the 30 per cent by weight content of the dry substance and impregnated with the reaction liquid (aqueous base solution) is treated with the bleaching agent. Lignin content in the primary product is equal to 30 κ units. The process is conducted according to the following conditions. The bleaching agent is oxygen. The mix of air and oxygen is used as a transfer agent. The ratio between the masses of cellulose and transfer agent is 20:1. Process time is 3 minutes. The velocity of the reaction mass flow in the reactor is 1.33 m/s. The ratio between the diameters of tube and loop of the reactor is 1:26. The pressure in the reactor is 1 kg/cm$^2$. The temperature in the reaction zone is 60° C. The process is conducted according to the conditions listed above. After the process, lignin content in the cellulose mass is 19 κ units. Consumption of the reaction agent is 19.7 kg for a ton of cellulose. Analysis of the processed cellulose mass on the outlet of the reactor indicated the total absence of the bleaching agent in the volume of cellulose.

EXAMPLE 2

Cellulose mass with the same quality index as in the example 1 is treated with the bleaching agent. The process is conducted under the following conditions. Bleaching agent is a 1.5 percent water solution of the hydrogen peroxide. The air is used as a transfer agent. The ratio between the masses of cellulose and transfer agent is 20:1. Process time is 3 minutes. The velocity of the reaction mass flow in the reactor is 1.33 m/s. The ratio between the diameters of tube and loop of the reactor is 1:26. The pressure in the reactor is 1 kg/cm$^2$. The temperature in the reaction zone is 60° C. The process is conducted according to the conditions listed above. After the process, lignin content in the cellulose mass was 19 κ units. Consumption of the reaction agent is 12 kg for a ton of cellulose. Analysis of the processed cellulose mass on the outlet of the reactor indicated the total absence of the bleaching agent in the volume of cellulose.

For comparison, previously known method, used for bleaching of the same kind of cellulose (Russian Federation Patent No 903419, 1993), gives 27 κ units lignin content in the output cellulose mass. The bleaching agent can be observed on the outlet of the reactor. The utilization degree of the reaction agent is no more than 15 percent.

According to the data listed above, the invention performed allows to conduct higher efficient processing of the fibrous mass by the reaction agent use and, as a result, to reduce the consumption of the reaction agent and to raise the quality of processed material through the agency of intensification of mass-transfer processes and uniform distribution of the reaction agent in the whole volume of the reaction mass. Current method and set up, developed for the realization of this method, allow to conduct the processing of highly concentrated fibrous mass with the use of a chemical agent in gas or liquid conditions as well, and the structure of the reactor appreciably reduces the metal volume needed for the equipment and the surface engaged.

What is claimed is:

1. A method for processing a fibrous mass by a chemical agent comprising the steps of:

mixing the fibrous mass with a gas transfer agent to form a fibrous mixture and feeding the fibrous mixture to a spiral shaped flow-type tube cell, feeding a chemical agent in jets attached lengthwise to the side of the tube cell to contact and process the fibrous mixture in the tube cell, and accumulating the processed fibrous mixture from the tube cell in an accumulation cell, wherein the tube cell is formed as a spiral looped around the accumulation cell with a 1:18–1:60 ratio between the tube and the spiral diameters and the fibrous mixture is conducted in a turbulent regime of motion with a velocity of 1–50 m/s in the tube cell.

2. The process of claim 1 wherein the fibrous mass is mixed with the gas transfer agent with a 10–60:1 mass ratio.

3. The process of claim 2 wherein the chemical agent is a gas.

4. The process of claim 3 wherein the chemical agent is an aqueous solution of chlorine dioxide or hydrogen peroxide.

5. The process of claim 4 wherein the gas transfer agent is air or distilled vapor.

6. A device for processing a fibrous mass by a chemical agent comprising:

a cell for mixing the fibrous mass and a gas transfer agent, the cell having an inlet and outlet, a device for loading the fibrous mass having an inlet for feeding the gas transfer agent to the inlet of the mixing cell, a flow-type tube cell connected to the outlet of the mixing cell for transferring the fibrous mass and the gas transfer agent to an accumulation cell, feeding jets attached lengthwise to the side of the flow-type tube cell for feeding chemical agent to the fibrous mass, and an accumulation cell connected to the flow-type tube cell for processing the fibrous mass by the chemical agent, wherein the flow-type tube cell is formed as a spiral looped around the accumulation cell with a 1:18–1:60 ratio between the tube and the spiral diameters.

* * * * *